US010170863B2

(12) United States Patent
Qiu et al.

(10) Patent No.: US 10,170,863 B2
(45) Date of Patent: Jan. 1, 2019

(54) ELECTRICAL CONNECTOR

(71) Applicant: FOXCONN INTERCONNECT TECHNOLOGY LIMITED, Grand Cayman (KY)

(72) Inventors: Jin-Guo Qiu, Huaian (CN); Gang Hu, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 3 days.

(21) Appl. No.: 15/640,460

(22) Filed: Jul. 1, 2017

(65) Prior Publication Data

US 2017/0373442 A1 Dec. 28, 2017

Related U.S. Application Data

(63) Continuation-in-part of application No. 15/629,771, filed on Jun. 22, 2017.

(30) Foreign Application Priority Data

Jun. 22, 2016 (CN) ..... 2016 1 0455661
Jul. 1, 2016 (CN) ..... 2016 1 0507804

(51) Int. Cl.
*H01R 12/58* (2011.01)
*H01R 13/6581* (2011.01)
(Continued)

(52) U.S. Cl.
CPC ..... *H01R 13/6581* (2013.01); *H01R 12/58* (2013.01); *H01R 13/514* (2013.01);
(Continued)

(58) Field of Classification Search
CPC .... H01R 13/52; H01R 13/502; H01R 13/514; H01R 13/6581; H01R 13/6585; H01R 13/6591; H01R 12/58; H01R 12/71
See application file for complete search history.

(56) References Cited

U.S. PATENT DOCUMENTS 6,120,323 A * 9/2000 Zhung ..... H01R 12/7023 439/567
6,186,830 B1 * 2/2001 Lin ..... H01R 13/6594 439/607.4
(Continued)

FOREIGN PATENT DOCUMENTS

CN 203607613 U 5/2014
CN 204118373 U 1/2015
(Continued)

*Primary Examiner* — Edwin A. Leon
*Assistant Examiner* — Oscar Jimenez
(74) *Attorney, Agent, or Firm* — Wei Te Chung; Ming Chieh Chang

(57) ABSTRACT

An electrical connector includes an insulative housing, a number of conductive terminals affixed to the insulative housing, a shielding shell enclosing the insulative housing; and a sealer. The insulative housing includes a base portion and a tongue portion extending forwardly from the base portion. Each conductive terminal includes a contacting portion exposed to the tongue portion. The shielding shell includes a number of locking grooves penetrating rearward and a number of tubers and each sandwiched between two locking grooves. The sealer seals a rear end of the shielding shell. The sealer includes a number of tubers corresponded with the locking grooves of the shielding shell and a number of locking grooves receiving the tubers of the shielding shell.

18 Claims, 16 Drawing Sheets

(51) Int. Cl.

| | |
|---|---|
| ***H01R 13/6585*** | (2011.01) |
| ***H01R 13/6591*** | (2011.01) |
| ***H01R 13/514*** | (2006.01) |
| ***H01R 24/60*** | (2011.01) |
| *H01R 107/00* | (2006.01) |

(52) U.S. Cl.
CPC ..... *H01R 13/6585* (2013.01); *H01R 13/6591* (2013.01); *H01R 24/60* (2013.01); *H01R 2107/00* (2013.01)

(56) References Cited

U.S. PATENT DOCUMENTS

| | | | | |
|---|---|---|---|---|
| 7,549,896 | B2 * | 6/2009 | Zhang | H01R 12/707 439/607.01 |
| 7,748,999 | B1 * | 7/2010 | Sun | H01R 12/716 439/607.36 |
| 7,789,706 | B2 * | 9/2010 | Chen | H01R 13/504 439/607.35 |
| 7,841,901 | B2 * | 11/2010 | Yu | H01R 13/6658 439/620.01 |
| 7,922,535 | B1 * | 4/2011 | Jiang | H01R 13/5205 439/271 |
| 8,251,717 | B2 * | 8/2012 | Liao | H01R 13/46 439/95 |
| 8,337,245 | B1 * | 12/2012 | Wang | H01R 12/724 439/271 |
| 8,388,380 | B1 * | 3/2013 | Van der Steen | H01R 13/5202 439/607.36 |
| 8,408,942 | B1 * | 4/2013 | Huang | H01R 13/6581 439/607.54 |
| 9,022,800 | B2 | 5/2015 | Hon Hai | |
| 9,088,092 | B2 * | 7/2015 | Kuo | H01R 43/005 |
| 9,312,641 | B2 * | 4/2016 | Wang | H01R 13/6585 |
| 9,515,405 | B2 * | 12/2016 | Zhao | H01R 13/405 |
| 9,525,244 | B1 * | 12/2016 | Hsu | H01R 13/6585 |
| 9,653,850 | B1 * | 5/2017 | Su | H01R 13/6585 |
| 2009/0042450 | A1 * | 2/2009 | Zheng | H01R 13/658 439/660 |
| 2010/0210139 | A1 * | 8/2010 | Wei | H01R 13/502 439/607.01 |
| 2011/0159747 | A1 * | 6/2011 | Tung | H01R 13/506 439/660 |
| 2012/0015560 | A1 * | 1/2012 | Wei | H01R 13/502 439/626 |
| 2012/0231661 | A1 * | 9/2012 | Song | H01R 12/707 439/607.4 |
| 2013/0029515 | A1 * | 1/2013 | Lin | H01R 13/6581 439/345 |
| 2014/0073190 | A1 * | 3/2014 | Zhao | H01R 13/6594 439/626 |
| 2014/0245606 | A1 * | 9/2014 | Lin | H01R 13/6581 29/884 |
| 2016/0164218 | A1 * | 6/2016 | Lee | H01R 13/5202 439/587 |
| 2016/0233594 | A1 * | 8/2016 | Zhao | H01R 13/5202 |
| 2016/0294102 | A1 * | 10/2016 | Zhao | H01R 13/6581 |
| 2017/0070013 | A1 * | 3/2017 | Hsu | H01R 24/60 |
| 2017/0149172 | A1 * | 5/2017 | Nishikata | H01R 13/627 |
| 2017/0155208 | A1 * | 6/2017 | Zhang | H01R 13/5216 |
| 2017/0201046 | A1 * | 7/2017 | Zhao | H01R 13/6586 |
| 2017/0201048 | A1 * | 7/2017 | Kong | H01R 13/6594 |
| 2017/0207581 | A1 * | 7/2017 | Zhang | H01R 13/6585 |
| 2017/0271823 | A1 * | 9/2017 | Zhao | H01R 13/6596 |
| 2017/0302033 | A1 * | 10/2017 | Peng | H01R 13/6581 |
| 2017/0365961 | A1 * | 12/2017 | Zhao | H01R 24/60 |
| 2017/0373438 | A1 * | 12/2017 | Qiu | H01R 13/6581 |
| 2017/0373439 | A1 * | 12/2017 | Wen | H01R 13/6581 |
| 2018/0006408 | A1 * | 1/2018 | Wen | H01R 13/6581 |

FOREIGN PATENT DOCUMENTS

| | | |
|---|---|---|
| CN | 204304093 U | 4/2015 |
| CN | 105322341 A | 2/2016 |
| CN | 105356109 A | 2/2016 |
| CN | 205069930 U | 3/2016 |
| CN | 205159614 U | 4/2016 |
| CN | 105552618 | 5/2016 |
| CN | 105552618 A | 5/2016 |
| CN | 105655787 A | 6/2016 |
| CN | 105655787 A | 6/2016 |
| TW | M453271 | 5/2013 |
| TW | M472975 | 2/2014 |

* cited by examiner

ELECTRICAL CONNECTOR

BACKGROUND OF THE DISCLOSURE

1. Field of the Disclosure

The present disclosure relates to an electrical connector, and more particularly to an electrical connector adapted for normally and reversely mating.

2. Description of Related Arts

China Patent No. 205159614 discloses a receptacle connector comprising an insulative housing, a plurality of conductive terminals insert-molded with the insulative housing, and a metal shell enclosing the insulative housing. The insulative housing includes a base portion and a tongue portion extending forwardly from the base portion. Each conductive terminal comprises a contacting portion exposed to an upper surface or a lower surface of the tongue portion, and a soldering portion extending rearward from the base portion. The metal shell comprises a top wall, a bottom wall opposite to the top wall, and a pair of lateral walls connecting the top wall and the bottom wall for forming a mating hole. The tongue portion is located in the mating hole. The contacting portions are exposed to the mating hole. The base portion comprises a plurality of notches located at an outer surface of the base portion. The metal shell encloses the notches and forms a gap between the notches and the metal shell. The receptacle connector comprises insulative materials overmolded with the insulative housing and sealing the gap and the notches. While the attaching force is too weak to maintain the insulative materials sealing the gap and the notches.

An improved electrical connector is desired.

SUMMARY OF THE DISCLOSURE

Accordingly, an object of the present disclosure is to provide an electrical connector making an insulative housing, a shielding shell and a sealer affixed to each other.

To achieve the above object, an electrical connector comprises: an insulative housing comprising a base portion and a tongue portion extending forwardly from the base portion; a plurality of conductive terminals affixed to the insulative housing and each comprising a contacting portion exposed to the tongue portion; a shielding shell enclosing the insulative housing; and a sealer; wherein the shielding shell comprises a plurality of locking grooves penetrating rearward and a plurality of tubers each between two adjacent locking grooves, the sealer seals a rear end of the shielding shell, and the sealer comprises a plurality of tubers engaging the locking grooves of the shielding shell and a plurality of locking grooves receiving the tubers of the shielding shell.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
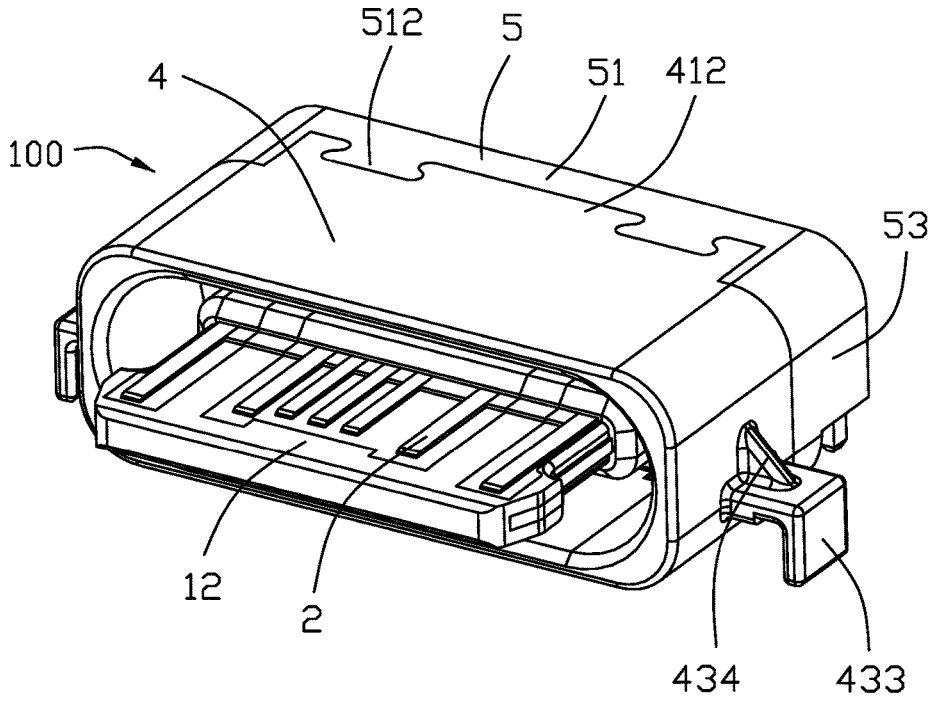
FIG. 1 is a perspective, assembled view of an electrical connector.
Figure 2:
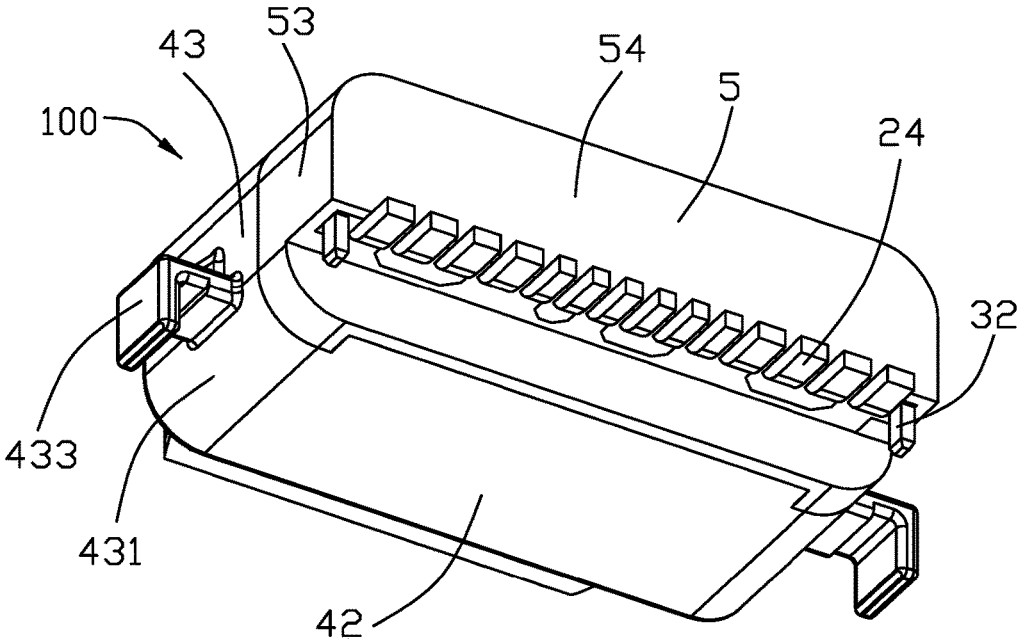
FIG. 2 is another perspective, assembled view of the electrical connector taken from FIG. 1.
Figure 3:
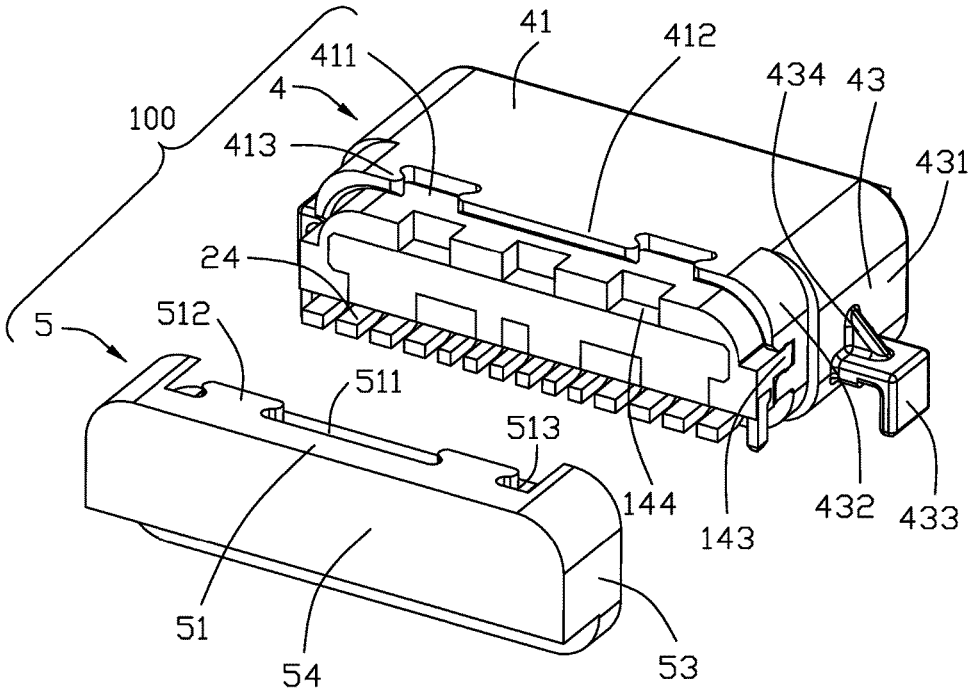
FIG. 3 is a partial exploded view of the electrical connector.

Reference will now be made in detail to the embodiments of the present disclosure. The insertion direction is a front-to-rear direction.

Referring to FIGS. 1 to 16, an electrical connector 100 includes an insulative housing 1, a number of conductive terminals 2 affixed to the insulative housing 1, a pair of shielding plates 3 affixed to the insulative housing 1, a shielding shell 4 enclosing the insulative housing 1, and a sealer 5, wherein the combination of the housing 1, the terminals 2 and the shielding plate 3 is a so-called terminal module which is forwardly assembled into the shielding shell 4.

Referring to FIGS. 4-7 and 11, the insulative housing 1 includes a base portion 11 and a tongue portion 12 extending forwardly from the base portion 11 along a front-to-back direction. The insulative housing 1 is essentially formed by a first insulator 13 and a second insulator 14 in different insert-molding process. The first insulator 13 includes a first base portion 131 and a first tongue portion 132 extending forwardly from the first base portion 131. The first insulator 13 includes a fixed notch 134, a number of fixed portions 135, and a pair of receiving grooves 133 located at a lower surface of the first insulator 13. The second insulator 14 includes a second base portion 141 and a second tongue portion 142 extending forwardly from the second base portion 141. The second base portion 141 includes a number of locking slots 144 and a pair of ears 143 located at a rear end thereof. The first tongue portion 132 and the second tongue portion 142 are called the tongue portion 12.

Figure 10:
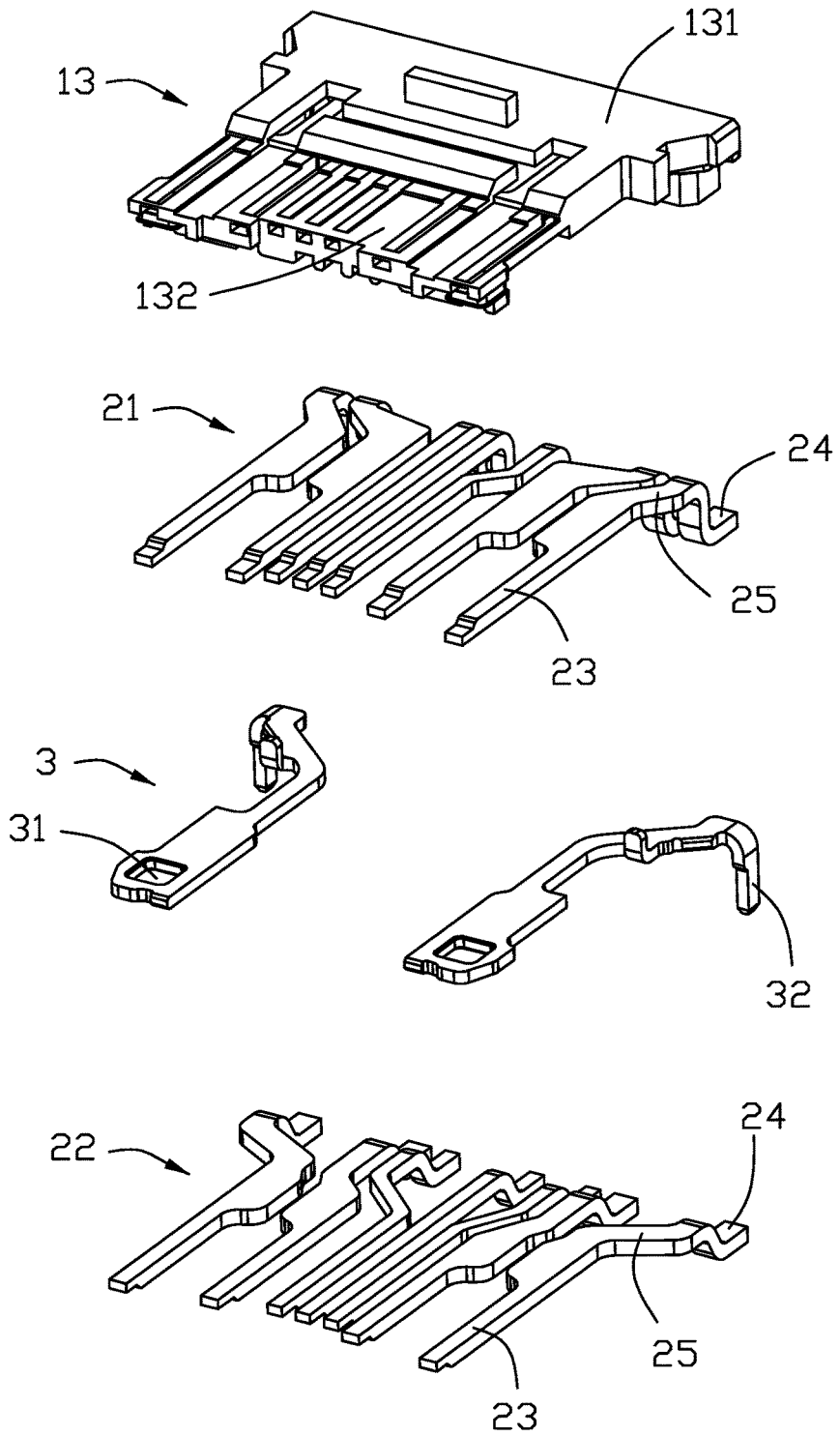
FIG. 10 is an exploded view of the first insulator, the conductive terminals and the shielding plate of the electrical connector.
Figure 11:
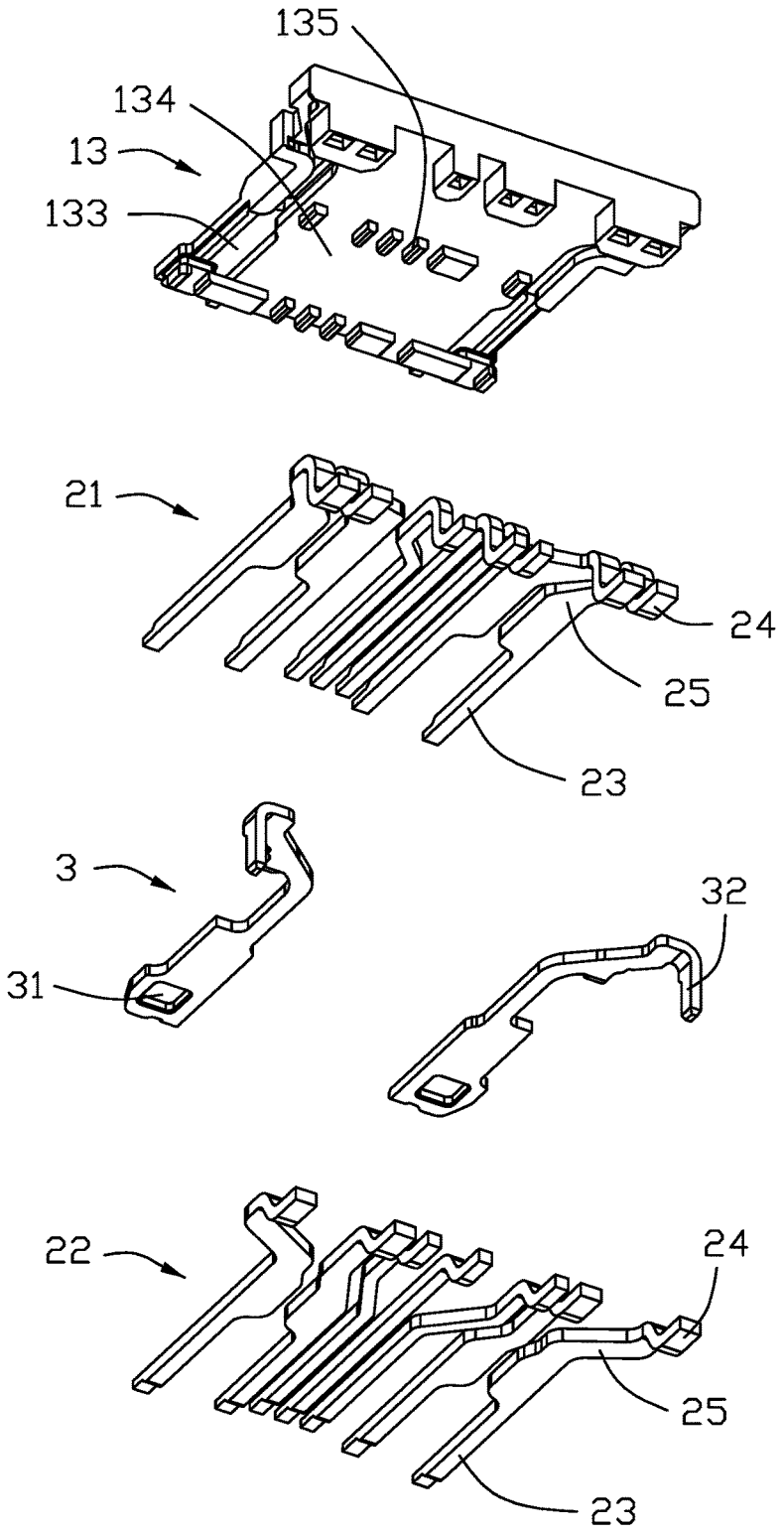
FIG. 11 is another exploded view of the first insulator, the conductive terminals and the shielding plate of the electrical connector taken from FIG. 10.

Referring to FIGS. 10 and 11, the conductive terminals 2 include a number of upper terminals 21 and lower terminals 22 and commonly categorized with grounding terminals, power terminals and signal terminals. The upper terminals 21 are equal with the lower terminals 22 in number. Each conductive terminal 2 includes a contacting portion 23 exposed to the tongue portion 12, a soldering portion 24 extending rearward from the base portion 11, and a fixed portion 25 connecting the contacting portion 23 and the soldering portion 25. Each contacting portion 23 of the upper terminals is positioned in reverse symmetry with respect to a respective one of the lower terminals.

The shielding plates 3 are separated from each other. Each shielding plate 3 includes a through hole 31 located at a front end thereof and a soldering pin 32 located at a rear end thereof.

Figure 4:
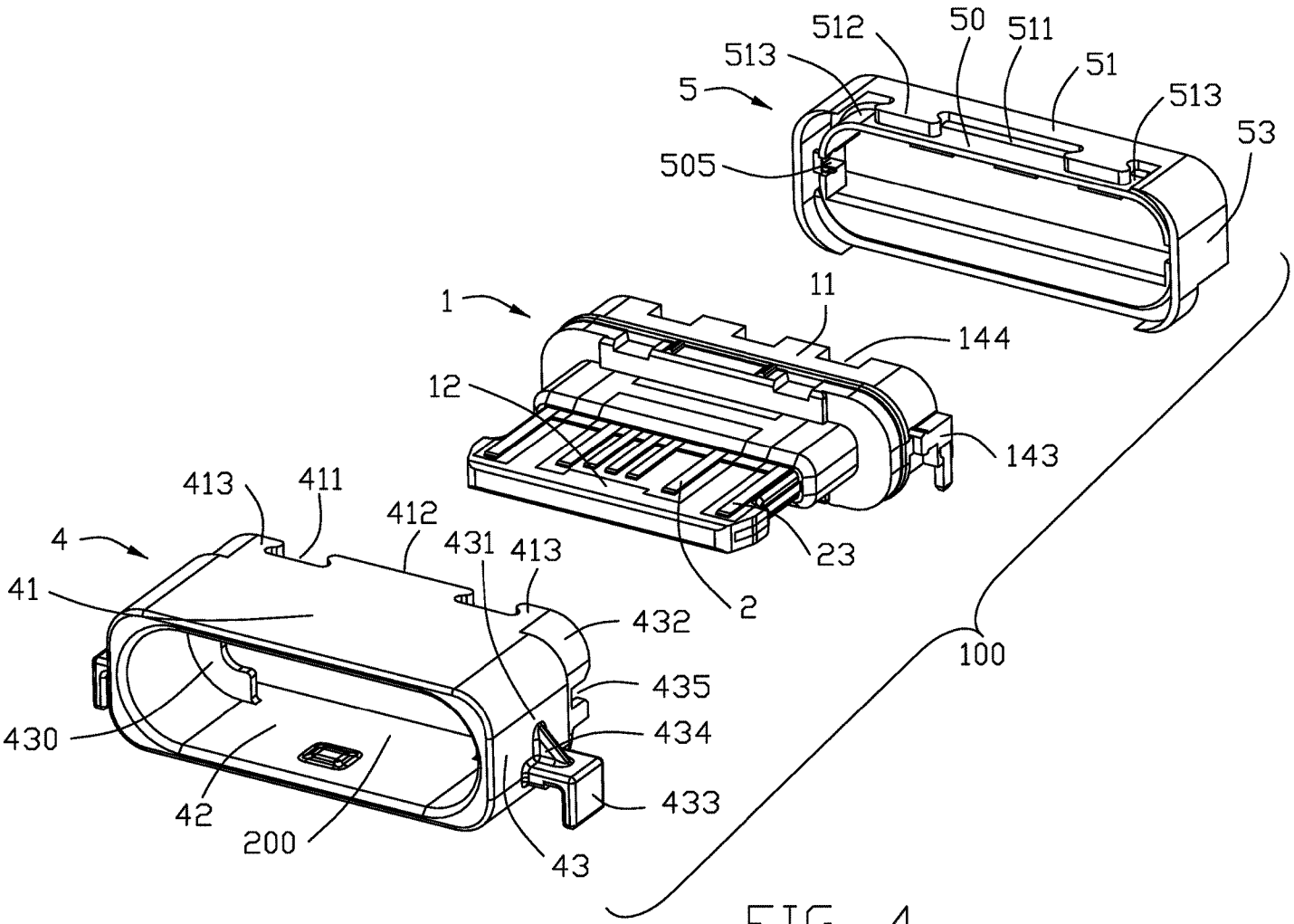
FIG. 4 is a further partial exploded view of the electrical connector.
Figure 5:
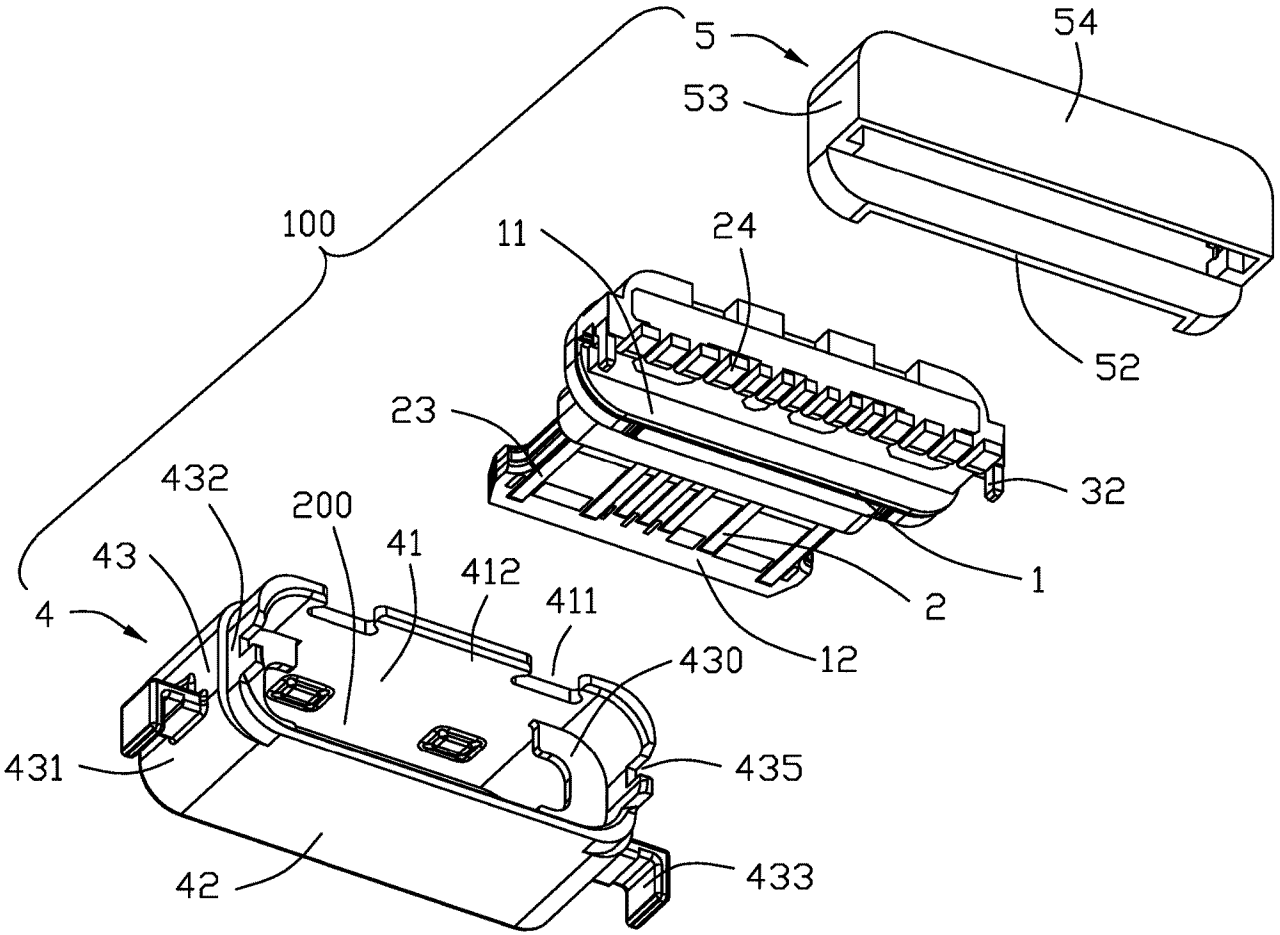
FIG. 5 is another partial exploded view of the electrical connector taken from FIG. 4.

Referring to FIGS. 4 to 5, the shielding shell 4 is formed by metal injection molding with different thicknesses at different positions, compared with the stamping type metallic shell with the same thickness therof. The shielding shell 4 includes an upper wall 41, a lower wall 42 opposite to the upper wall 41, and a pair of lateral walls 43 connecting the upper wall 41 and the lower wall 42 for forming a receiving room 200. The shielding shell 4 includes a pair of first locking grooves 411 located at a rear end of the upper wall 41, a first tuber 412 located between the locking grooves 411, and a pair of protrusions 413 located at two sides of the locking grooves 411. Each lateral wall 43 includes a front lateral wall 431 located at a front end thereof and a rear lateral wall 432 located at a rear end thereof. The front lateral wall 431 includes a pair of fixed pins 433 extending outwardly and a pair of stiffener 434 connecting the fixed pins 433 and the front lateral wall 431. The rear lateral wall 432 includes a pair of recesses 435 depressed forwardly and located at a middle position. The shielding shell 4 further includes a pair of barriers 430 protruding into the receiving room 200.

Figure 12:
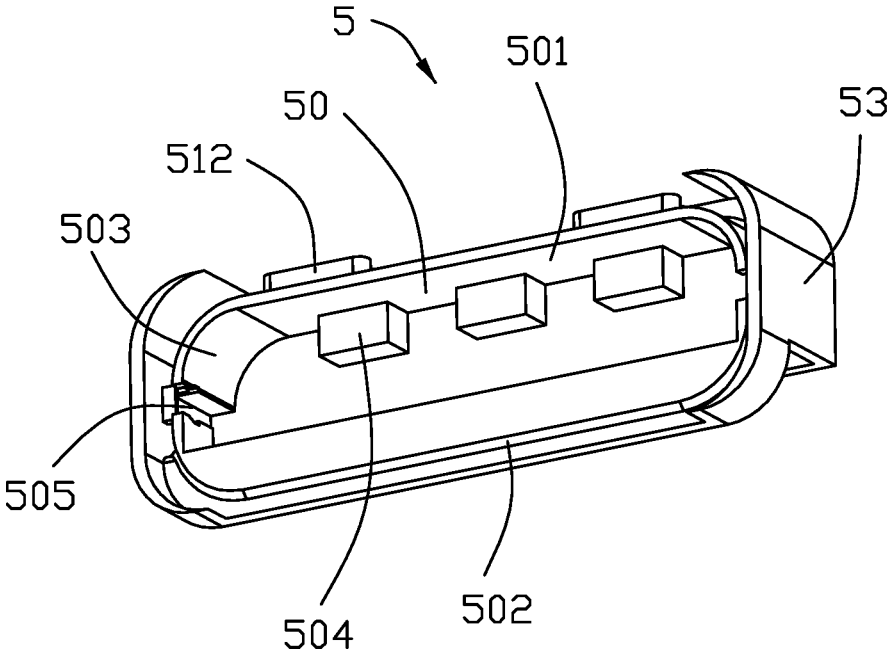
FIG. 12 is a perspective, assembled view of a sealer of the electrical connector.
Figure 13:
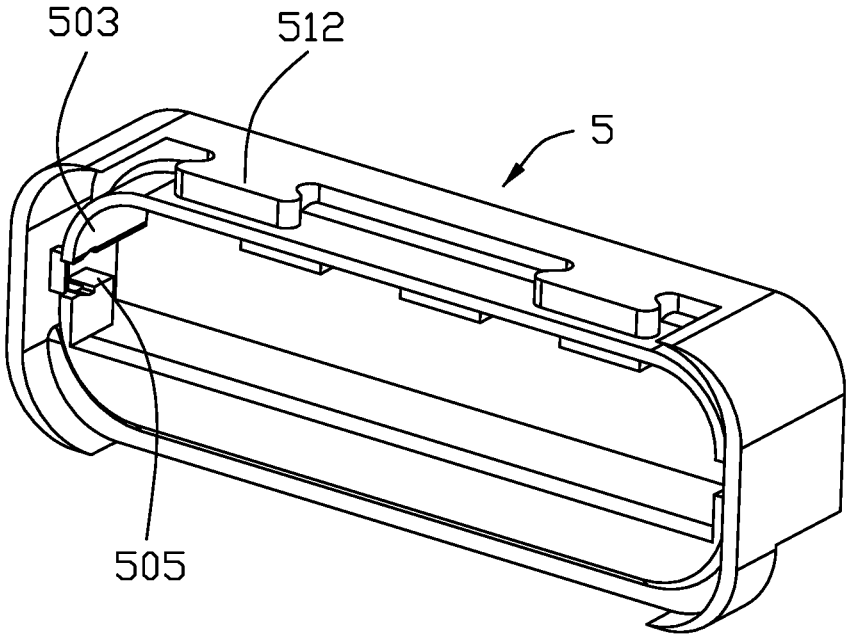
FIG. 13 is another perspective view of the sealer of the electrical connector.
Figure 14:
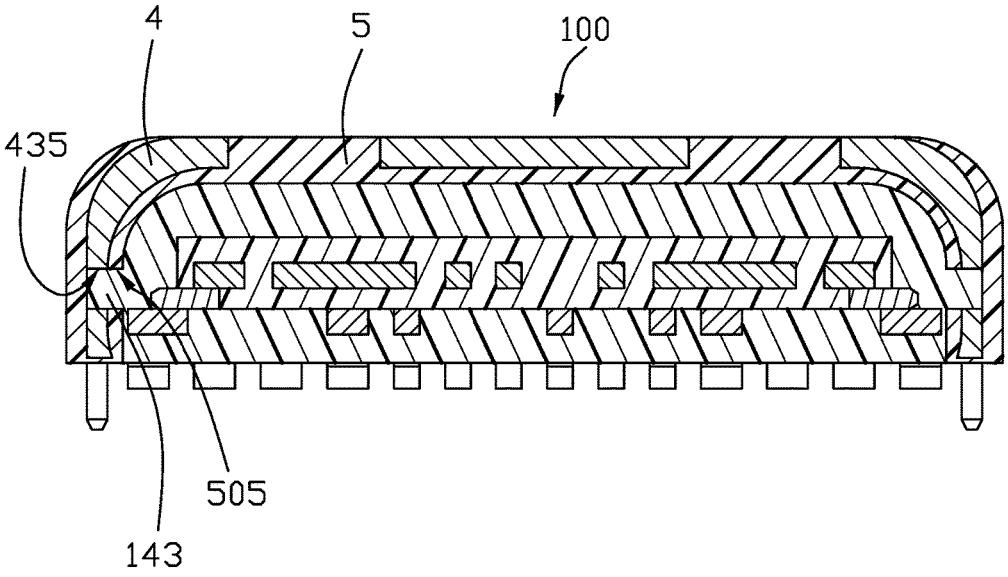
FIG. 14 is a cross-sectional view of the electrical connector to show how the ear to be engaged within both the shell and the sealer.
Figure 15:
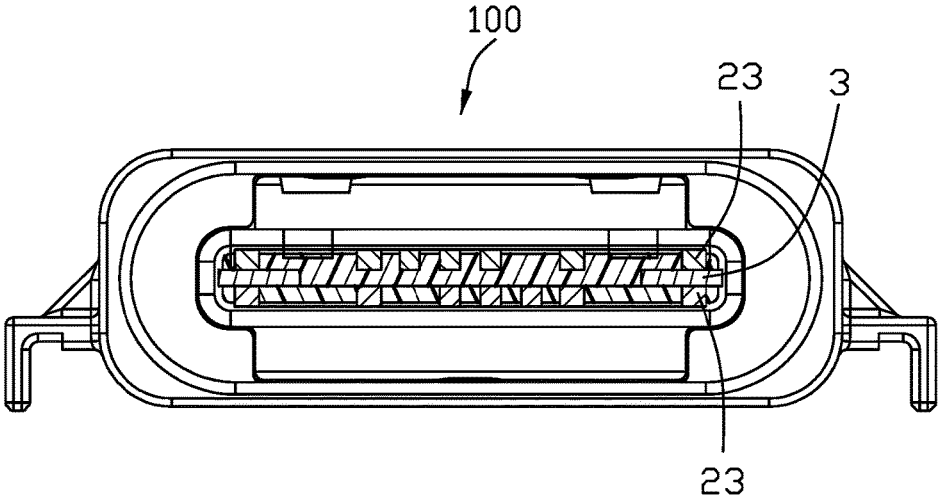
FIG. 15 is another cross-sectional view of the electrical connector to show the shielding plate sandwiched between the corresponding grounding terminals.
Figure 16:
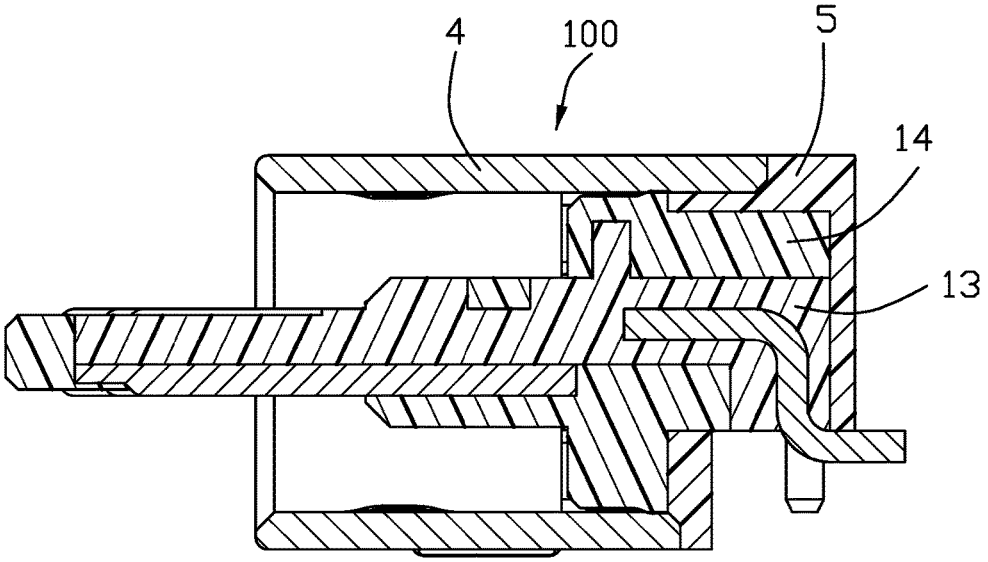
FIG. 16 is another cross-sectional view of the electrical connector to show the sealer covers the back side of the electrical connector.

Referring to FIGS. 4-5 and 12, the sealer 5 is a closed structure and includes a surrounding portion 50. The sealer 5 includes a top board 51, a bottom board 52 opposite to the top board 51, a pair of lateral boards 53 connecting the top board 51 and the bottom board 52, and a rear board 54 sealing a rear end of the sealer 5. The top board 51 includes a second locking groove 511 located at a middle position, a pair of second tubers 512 located laterally of the second locking groove 511 and a pair of accommodating grooves 513 located laterally of the second tubers 512. The surrounding portion 50 includes an upper portion 501, a lower portion 502 opposite to the upper portion 501, and a pair of lateral portions 503 connecting the upper portion 501 and the bottom portion 502. The upper portion 501 includes a number of protruding portions 504 extending downwardly. Each lateral portion 503 includes a receiving notch 505.

Figure 8:
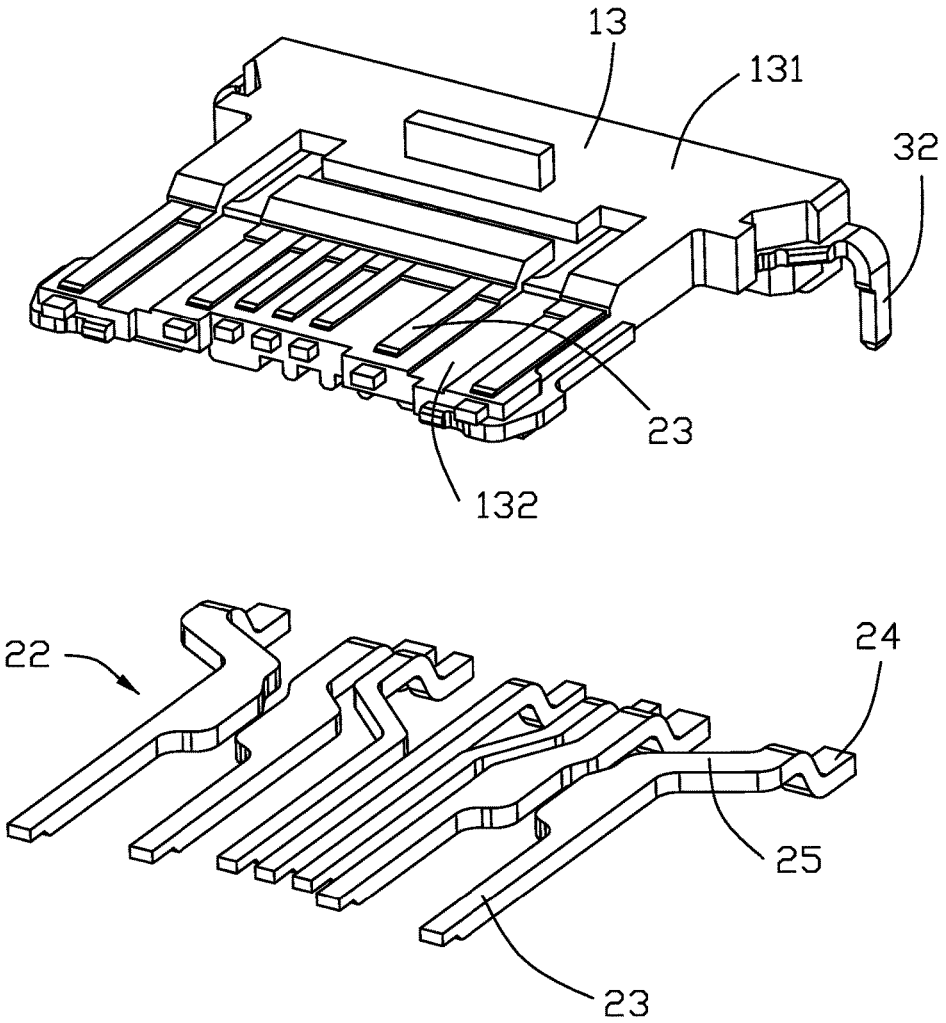
FIG. 8 is a partial exploded view of a first insulator, the conductive terminals and the shielding plate of the electrical connector.
Figure 9:
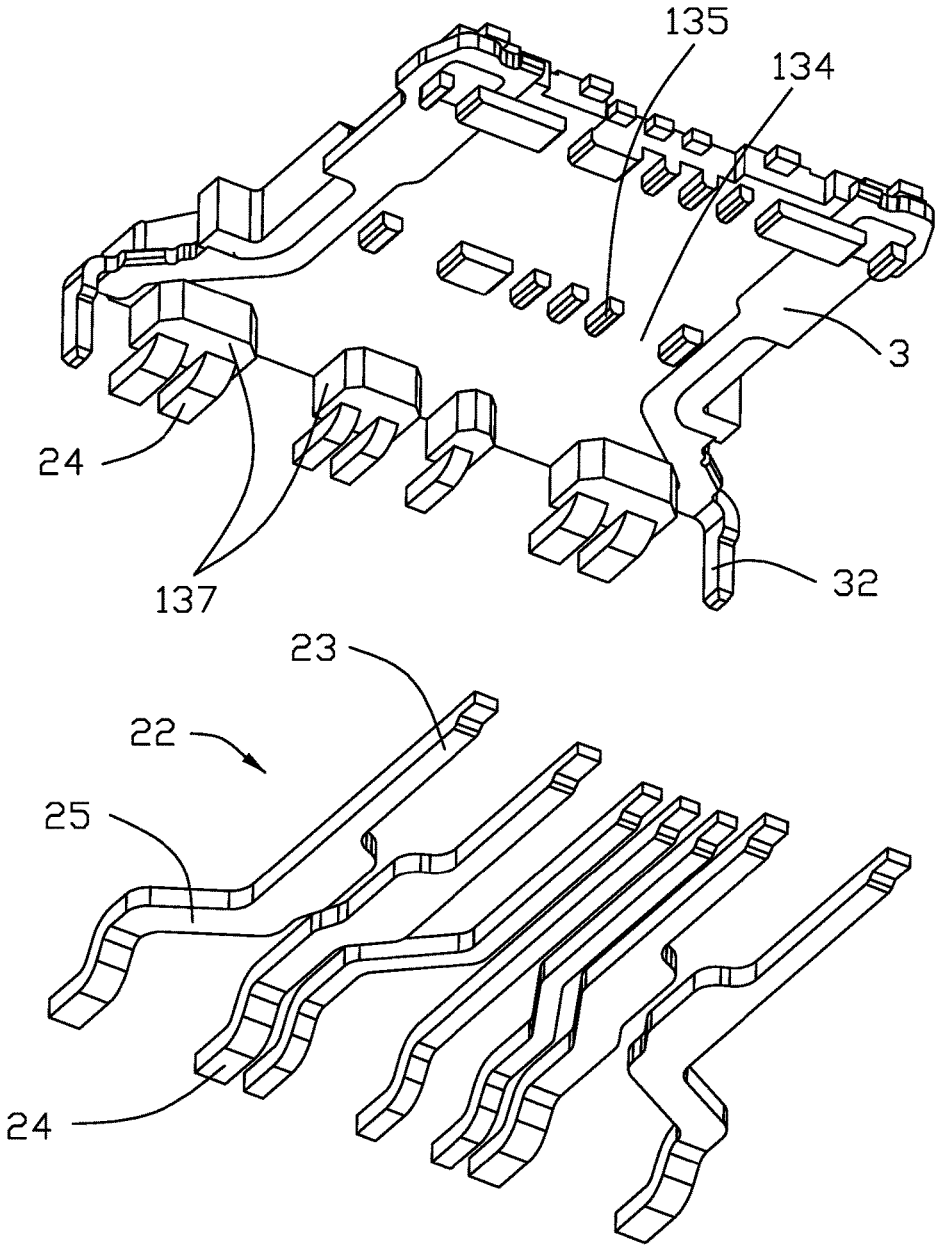
FIG. 9 is another partial exploded view of the first insulator, the conductive terminals and the shielding plate of the electrical connector taken from FIG. 8.

Referring to FIGS. 8 and 9, the method of making the electrical connector 100 includes the following steps. In a first step, the upper terminals 21 and the shielding plate 3 are insert-molded with the first insulator 13 to commonly form a sub-assembly. The contacting portions 23 of the upper terminals are exposed to the first tongue portion 132. The fixed portions 25 of the upper terminals 21 are affixed to the first insulator 13. The soldering portions 24 of the upper terminals 21 extend out of the first insulator 13. The shielding plates 3 are received in the receiving grooves 133 and the soldering pins 32 extend laterally of the first insulator 13.

In a second step, the lower terminals 22 are assembled upon the sub-assembly by fitting into the fixed notch 134 to be retained by the fixed portions 135.

Figure 6:
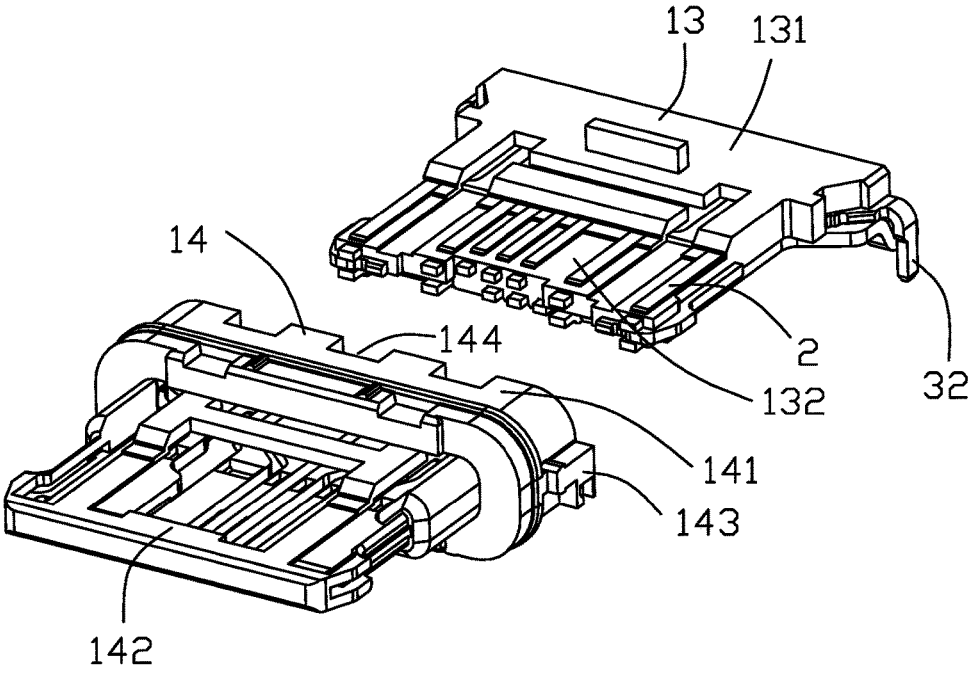
FIG. 6 is a partial exploded view of an insulative housing, a number of conductive terminals and a shielding plate of the electrical connector.
Figure 7:
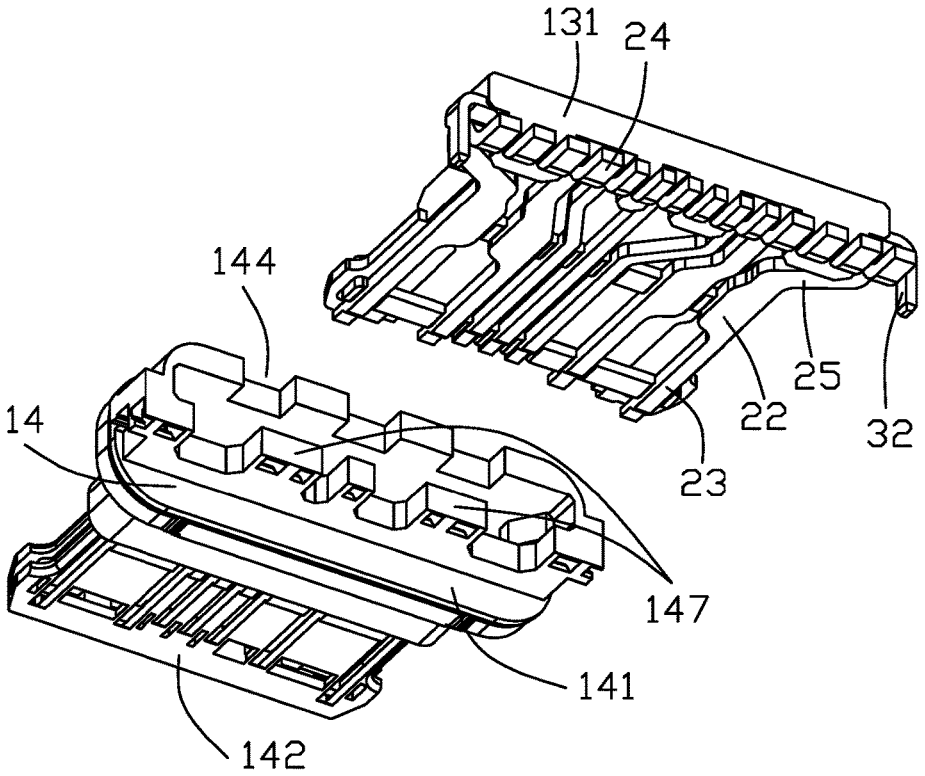
FIG. 7 is another partial exploded view of the insulative housing, the conductive terminals and the shielding plate taken from FIG. 6.

In a third step, referring to FIGS. 6 to 7, the sub-assembly and the lower terminals assembled thereon are further insert-molded within the second insulator 14. The contacting portions 23 are exposed to an upper surface and a lower surface of the tongue portion 12. The fixed portions 25 are affixed to the insulative housing 1. The soldering portions 24 extend outwardly from a rear end of the insulative housing 1.

In a fourth step, referring to FIGS. 4 to 5, the insulative housing 1 is assembled to the shielding shell 4 along a rear-to-front direction. A front surface of the base portion 11 resists against a rear surface of the barriers 430. The ears 143 are stuck in the recesses 435. There exists a gap between the base portion 11 and the shielding shell 4.

In a fifth step, referring to FIGS. 1 to 5, the sealer 5 is formed by insert molding or overmolding. The sealer 5 seals a rear end of the shielding shell 4. The surrounding portion 50 seals the gap between the insulative housing 1 and the shielding shell 4. The first tuber 412 is stuck in the second locking groove 511. The pair of second tubers are stuck in the pair of first locking groove 411. The pair of protrusions 413 are stuck in the pair of accommodating grooves 513. The protruding portions 504 are received in the locking slots 144. The receiving notches 505 receive the ears 143. The lateral boards 53 enclose the rear lateral walls 432 making the lateral boards 53 aligned with the front lateral walls 431.

Compared with prior arts, although the shielding shell 4 is formed by Metal Injection Molding (MIM), the attaching force between the shielding shell 4 and the sealer 5 is too weak. The shielding shell 4 includes the pair of first locking grooves 411 mated with the pair of second tubers 512 of the sealer 5, and the first tuber 412 mated with the second locking groove 511 of the sealer 5 which can reinforce the attaching force between the shielding shell 4 and the sealer 5. Understandably, in the traditional design having the MIN shielding shell, the securing between the metal injection molding shielding shell and the terminal module is required to solder the lateral extensions of the shielding plate with the interior face of the shielding shell. Differently, by adopting the retention mechanism disclosed in the copending parent application Ser. No. 15/629,771 filed on Jun. 22, 2017, the instant invention uses the ears 143 of the second insulator 14 wherein the outer part of the ear 143 is engaged within the corresponding recesses 435 of the shielding shell 4 while the inner part of the ear 143 is received within the notch 505 of the sealer 5 in place of the aforementioned soldering method. Anyhow, both the instant application and the aforementioned parent application use the sealer 5 to assist securing between the terminal module and the MIM shielding shell.

Another feature of the invention is that all the soldering portions 24 of both the upper terminals 21 and lower terminals 22 are arranged in one row, wherein the soldering portions 24 of the upper terminals 21 are retained by the corresponding first tail blocks 137 formed on the first insulator 13 while the soldering portions 24 of the lower terminals 22 are retained by the corresponding second tail blocks 147 formed on the second insulator 14, and the first tail blocks 137 and the second tail blocks 147 are alternately arranged with each other along the transverse direction.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base portion and a tongue portion extending forwardly from the base portion;

a plurality of conductive terminals affixed to the insulative housing and each comprising a contacting portion exposed to the tongue portion;

a shielding shell enclosing the insulative housing; and a sealer; wherein the shielding shell comprises a plurality of locking grooves penetrating rearward and a tuber between two adjacent locking grooves, the sealer seals a rear end of the shielding shell, the sealer comprises a plurality of tubers engaging the locking grooves of the shielding shell, a locking groove receiving the tuber of the shielding shell, and a surrounding portion sealing a gap between the insulative housing and the shielding shell, and the surrounding portion comprises an upper portion, a lower portion, and a pair of lateral portions connecting the upper portion and the lower portion and each comprising a receiving notch, the base portion has a pair of ears located laterally, and the receiving notches receive the ears.

2. The electrical connector as claimed in claim 1, wherein the shielding shell is formed by metal injection molding, the shielding shell comprises an upper wall, the sealer comprises a top board, the tubers comprise a first tuber located at the upper wall and a pair of second tubers located at the top board, the locking grooves comprise a pair of first locking grooves located at two sides of the first tuber and a second locking groove located between the pair of second tubers, the first tuber is stuck in the second locking groove, and the pair of second tubers are stuck in the pair of first locking grooves.

3. The electrical connector as claimed in claim 2, wherein the upper wall comprises a pair of protrusions located at two sides of the pair of first locking grooves, the top board comprises a pair of accommodating grooves located at two sides of the pair of second tubers, and the pair of protrusions are mated with the pair of accommodating grooves.

4. The electrical connector as claimed in claim 1, wherein the shielding shell comprises a pair of lateral walls, each lateral wall has a front lateral wall located at a front end thereof and a rear lateral wall depressed inwardly and located at a rear end thereof, the sealer has a pair of lateral boards, and the lateral boards enclose the rear lateral walls and align the lateral boards with the front lateral walls.

5. The electrical connector as claimed in claim 4, wherein each rear lateral wall comprises a recess depressed forwardly, the base portion comprises a pair of ears at a rear end thereof, and the ears are engaged with the recesses.

6. The electrical connector as claimed in claim 1, wherein the upper portion comprises a plurality of protruding portions extending downwardly, the base portion has a plurality of locking slots located at a rear end thereof and the protruding portions are locked in the locking slots.

7. The electrical connector as claimed in claim 1, wherein the shielding shell comprises a barrier protruding inwardly from an inner surface thereof, and the base portion resists the barrier in a front-to-rear direction.

8. The electrical connector as claimed in claim 1, further comprising a pair of shielding plates spaced from each other and affixed to the insulative housing, and wherein the insulative housing includes a first insulator comprising a pair of receiving grooves located at a pair of lateral sides of a lower surface thereof, and the shielding plates are received in the receiving grooves.

9. The electrical connector as claimed in claim 8, wherein the first insulator comprises a fixed notch and a plurality of fixed portions located at the lower surface, and the conductive terminals comprise a plurality of lower terminals received in the fixed notch and affixed by the fixed portions.

10. An electrical connector comprising:

a metallic shielding shell;

a terminal module retained in the shielding shell and including an insulative housing with two rows of terminals therein, said housing including a base portion and a tongue portion extending forwardly from the base portion along a front-to-back direction, each of said terminals including a front contacting section and a rear soldering section, one row of terminals and a metallic shielding plate being initially commonly integrally formed within a first insulator to form a sub-assembly with the rear soldering sections of said one row of terminals retained in corresponding first tail blocks formed on the first insulator, another row of terminals successively disposed upon the sub-assembly and commonly integrally formed within a second insulator to commonly form the terminal module with the rear soldering sections of said another row of terminals retained in corresponding second tail blocks formed on the second insulator; wherein the first tail blocks and the second tail blocks are alternately arranged with each other in a transverse direction perpendicular to said front-to-back direction; and the rear soldering sections of the two rows of terminals are arranged in one row.

11. The electrical connector as claimed in claim 10, further including an insulative sealer overmolded upon a rear side of both said housing and said shell for preventing a backward movement of the housing with regard to the shell.

12. The electrical connector as claimed in claim 11, wherein the shell includes at least one locking groove fully filled by a tuber formed on the sealer to prevent relative movement between the shell and the sealer along the front-to-back direction.

13. The electrical connector as claimed in claim 10, wherein the housing includes a protruding ear with an outer part retainably received within a recess in the shell and an inner part received within a notch of the sealer, and wherein the shell is made by metal injection molding with different thicknesses at different positions.

14. The electrical connector as claimed in claim 10, wherein each row of terminals include signal terminals, power terminals and grounding terminals, and the shielding plate is sandwiched between the grounding terminals of said two rows of terminals in a vertical direction perpendicular to both said front-to-back direction and said transverse direction.

15. An electrical connector comprising:

a metallic shell made of metal injection molding with different thicknesses at different positions;

a terminal module received in the shell and including an insulative housing with two rows of terminals and a metallic shielding plate embedded therein, the housing including a base portion and a tongue portion forwardly extending from the base portion along a front-to-back direction, the base portion extending rearwardly beyond a rear edge of the shell, each of said terminals including a front contact section and a rear solder section; and an insulative sealer overmolded upon both the housing and the shell around a rear side of the connector; wherein the housing includes a protruding ear having an outer part retained within a recess formed in said rear edge of the shell, and an inner part retained within a notch of the sealer; wherein said terminal module is preformed and successively assembled to the metallic shell, and sealer is formed after the terminal module is assembled to the metallic shell.

16. The electrical connector as claimed in claim 15, wherein the shielding shell further forms a locking groove in another rear edge, and the sealer forms a tuber fully filling the locking groove with a locking configuration to prevent relative movement between the sealer and the shielding shell in the front-to-back direction.

17. The electrical connector as claimed in claim 15, wherein said sealer covers said protruding ear in a transverse direction perpendicular to said front-to-back direction.

18. The electrical connector as claimed in claim 15, wherein said sealer forms protruding portions received within corresponding locking slots formed in a rear face of the housing.

* * * * *